US006463989B1

(12) United States Patent
Johnson

(10) Patent No.: US 6,463,989 B1
(45) Date of Patent: Oct. 15, 2002

(54) OVERHEAD DOOR MOVEMENT BLOCKING SYSTEM

(76) Inventor: Lawrence A. Johnson, 26684 Apple La., Hartford, SD (US) 57033

( * ) Notice: Subject to any disclaimer, the term of this patent is extended or adjusted under 35 U.S.C. 154(b) by 0 days.

(21) Appl. No.: 09/876,973

(22) Filed: Jun. 8, 2001

Related U.S. Application Data

(60) Provisional application No. 60/210,788, filed on Jun. 12, 2000.

(51) Int. Cl.[7] ..... E05D 15/16

(52) U.S. Cl. ..... 160/201; 292/288

(58) Field of Search ..... 160/201; 16/82; 292/288, 289, DIG. 15, 342, 343; 70/416, 2, 176, 177, 180, 54–56

(56) References Cited

U.S. PATENT DOCUMENTS

| | | | | |
|---|---|---|---|---|
| 2,198,079 | A | | 4/1940 | Ferris et al. |
| 3,333,363 | A | | 8/1967 | Garvey |
| 3,622,190 | A | * | 11/1971 | Mohun |
| 3,756,641 | A | * | 9/1973 | Dugan |
| 3,961,816 | A | * | 6/1976 | Mueller |
| 3,975,041 | A | * | 8/1976 | Edison |
| 4,045,982 | A | * | 9/1977 | Gorton et al. |
| 4,080,757 | A | | 3/1978 | Westerman |
| 4,345,448 | A | * | 8/1982 | Solomon |
| D283,672 | S | * | 5/1986 | Greco |
| 4,613,175 | A | | 9/1986 | Nelson |
| 4,861,079 | A | | 8/1989 | DeForrest, Sr. |
| 5,001,861 | A | | 3/1991 | Hahn |
| 5,052,202 | A | * | 10/1991 | Murphy |
| 5,469,722 | A | * | 11/1995 | Ellefsen |
| 5,499,517 | A | * | 3/1996 | McCraw |
| 5,533,561 | A | | 7/1996 | Forehand, IV |
| 5,718,083 | A | | 2/1998 | Dowdell, II |
| 5,943,111 | A | * | 8/1999 | Hernandez |
| 6,053,547 | A | | 4/2000 | Lemieux |
| 6,082,430 | A | | 7/2000 | Mock |

* cited by examiner

*Primary Examiner*—Blair M. Johnson

(57) ABSTRACT

An overhead door movement blocking system for selectively blocking opening of an overhead door with a device that is easily and quickly removable and transferred to other overhead doors. The overhead door movement blocking system includes a block device for positioning in the channel of the guide track of an overhead door structure to obstruct movement of the guide roller of an overhead door in the channel past the block device. The block device has inner and outer faces, and an aperture is formed in the block device for aligning with a hole in the base wall of the guide track when the block device is positioned in the channel of the guide track. The aperture extends between the inner and outer faces. The block device has opposite first and second ends, with the first end being positionable adjacent to the guide roller of the overhead door. The first end has a concave face for positioning adjacent to and abutting the guide roller. The block device has a pair of opposite sides extending between the first and second ends for each being positioned adjacent to one of the side walls of the guide track. Optionally, the system may include a padlock having a shackle portion and a case portion, with the shackle portion being removably mountable in the aperture of the block device for positioning through the hole of the guide track to secure the block device in the channel to block movement of the guide roller in the channel past the block device.

9 Claims, 4 Drawing Sheets

OVERHEAD DOOR MOVEMENT BLOCKING SYSTEM

CROSS REFERENCE TO RELATED APPLICATION

This application claims the benefit of U.S. Provisional Application No. 60/210,788, filed Jun. 12, 2000.

BACKGROUND OF THE INVENTION

1. Field of the Invention

The present invention relates to overhead door locking systems and more particularly pertains to a new overhead door movement blocking system for selectively blocking opening of an overhead door with a device that is easily and quickly removable and transferred to other overhead doors.

2. Description of the Prior Art

The use of overhead door locking systems is known in the prior art. Known systems have employed structures that are permanently mounted on the structure adjacent to the overhead door, and that have elements that may be automatically extended into the guide track of the overhead door for obstructing movement of a roller along the guide track. Some of these automated systems are complex, and require constant electrical power to maintain the element in an extended or a retracted position. Further, these systems would appear to be relatively expensive if bought by a consumer.

Other systems are mounted directly on the interior of the overhead door, and are difficult to be moved from one overhead door installation to another, and thus requires a user to purchase a system for each overhead door to be locked. Some systems may be easily unlatched from the interior of the structure, and thus may be defeated if an unauthorized person is able to obtain access to the interior of the structure through another door. Many of the known systems only act on one lateral side of the overhead door, so that the other lateral side of the door is more vulnerable to prying or other applications of force.

The overhead door movement blocking system according to the present invention substantially departs from the conventional concepts and designs of the prior art, and in so doing provides an primarily developed for the purpose of selectively blocking opening of an overhead door with a device that is easily and quickly removable and transferred to other overhead doors.

SUMMARY OF THE INVENTION

In view of the foregoing disadvantages inherent in the known types of overhead door locking systems now present in the prior art, the present invention provides a new overhead door movement blocking system construction wherein the same can be utilized for selectively blocking opening of an overhead door with a device that is easily and quickly removable and transferred to other overhead doors.

The present invention generally comprises a block device for positioning in the channel of the guide track of an overhead door structure to obstruct movement of the guide roller of an overhead door in the channel past the block device. The block device has inner and outer faces, and an aperture is formed in the block device for aligning with a hole in the base wall of the guide track when the block device is positioned in the channel of the guide track. The aperture extends between the inner and outer faces. The block device has opposite first and second ends, with the first end being positionable adjacent to the guide roller of the overhead door. The first end has a concave face for positioning adjacent to and abutting the guide roller. The block device has a pair of opposite sides extending between the first and second ends for each being positioned adjacent to one of the side walls of the guide track. Optionally, the system may include a padlock having a shackle portion and a case portion, with the shackle portion being removably mountable in the aperture of the block device for positioning through the hole of the guide track to secure the block device in the channel to block movement of the guide roller in the channel past the block device.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
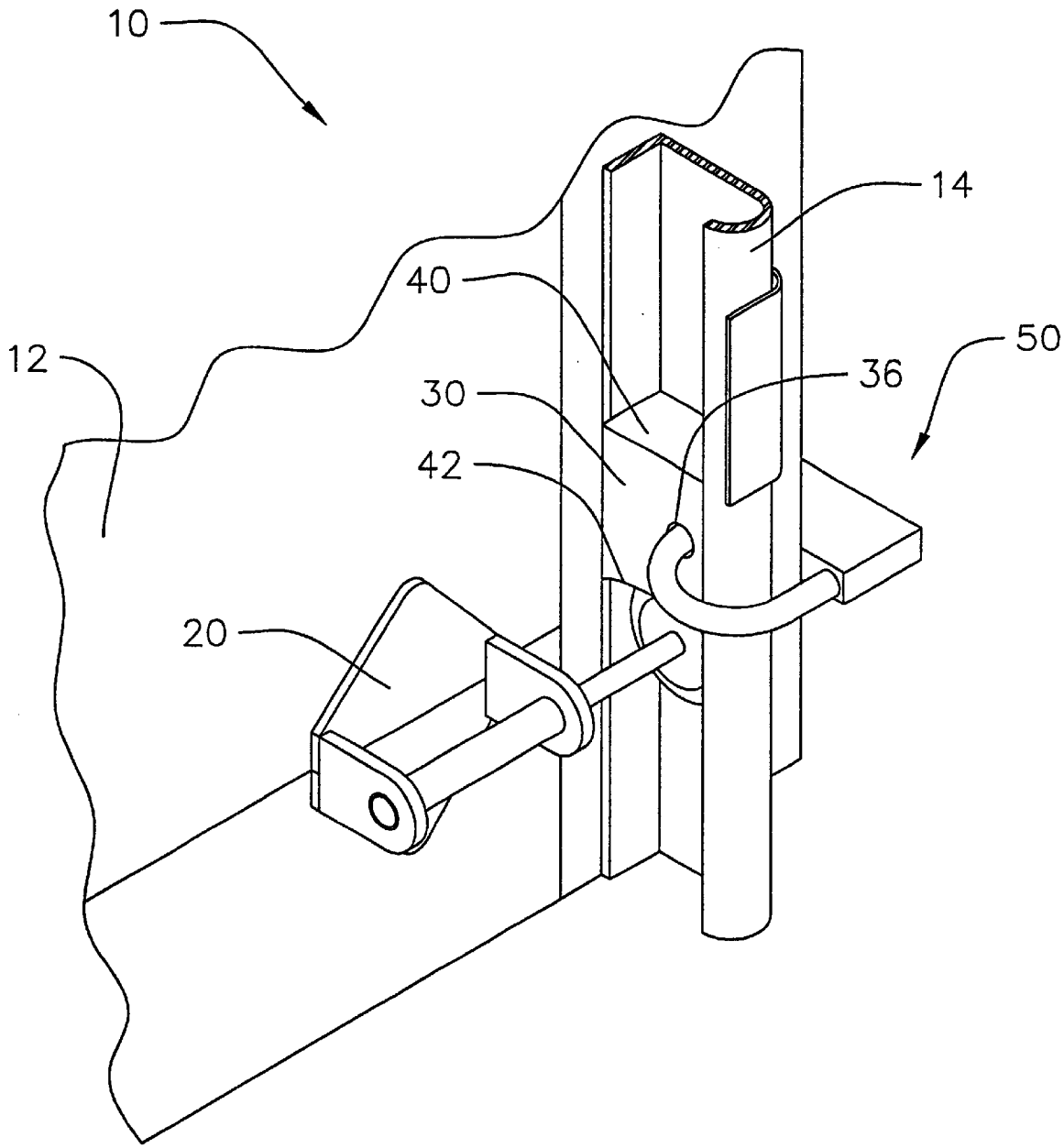
FIG. 1 is a schematic perspective view of a new overhead door movement blocking system according to the present invention.
Figure 2:
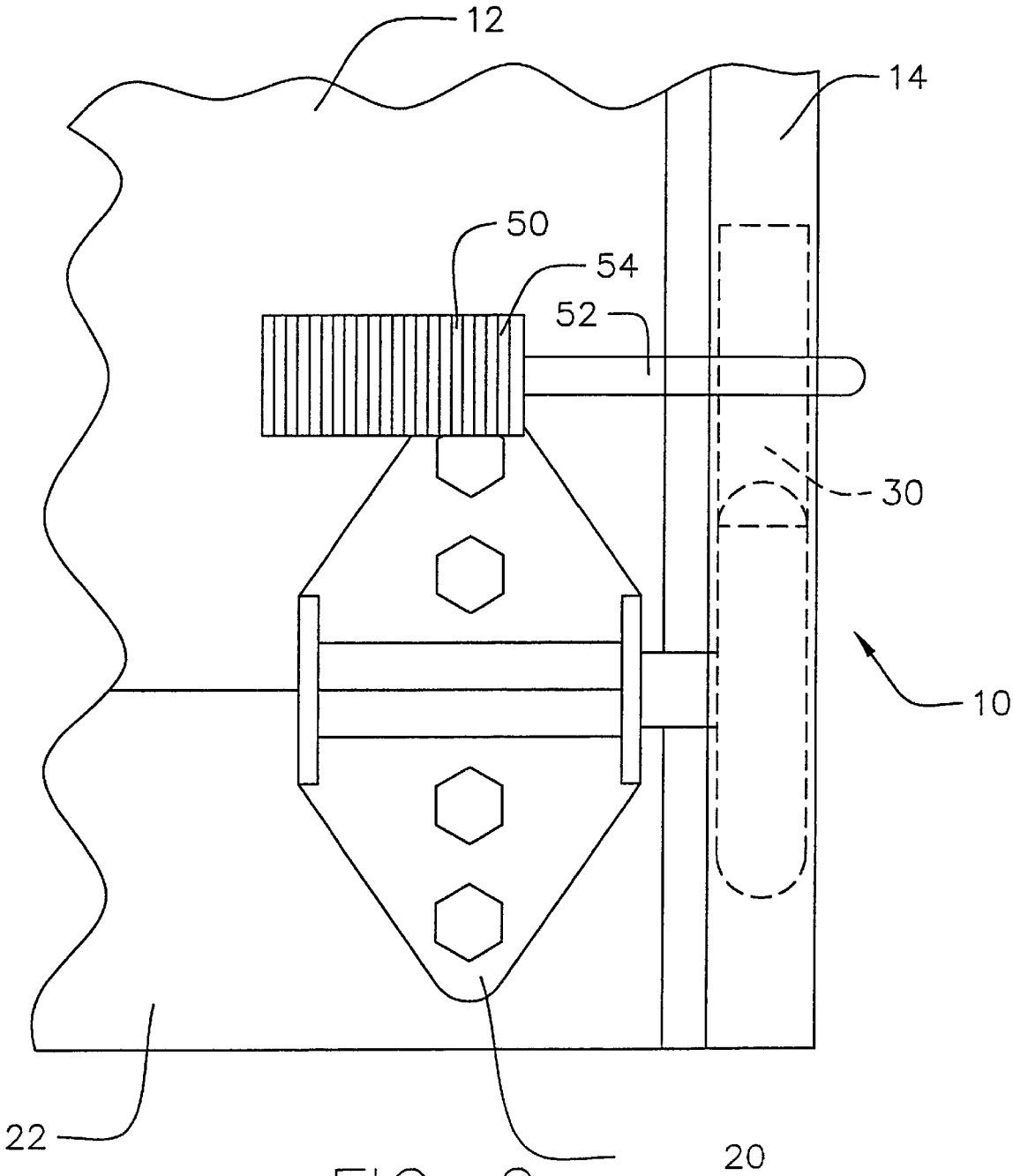
FIG. 2 is a schematic front elevation view of the present invention.
Figure 3:
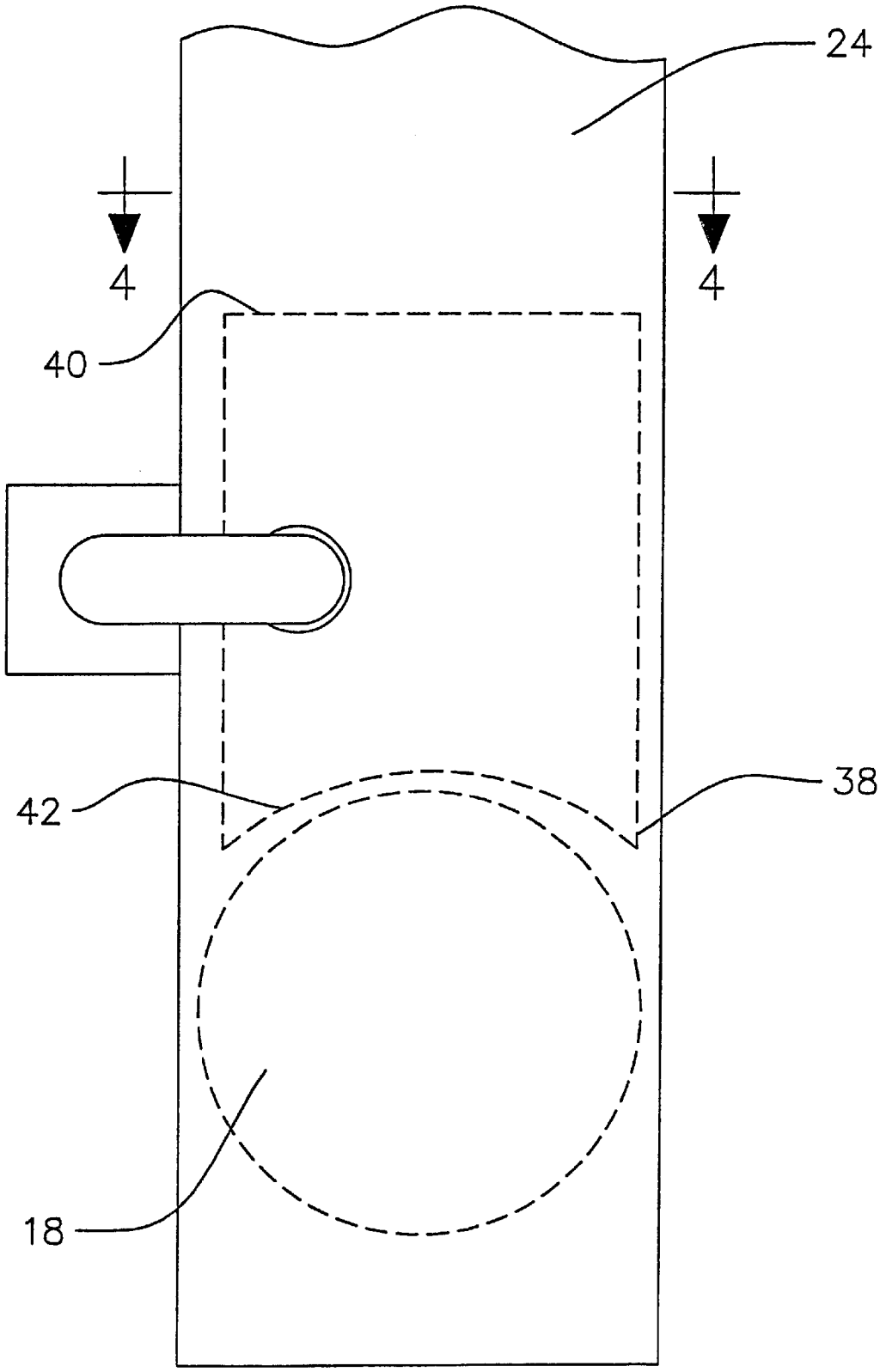
FIG. 3 is a schematic side elevation view of the present invention.
Figure 5:
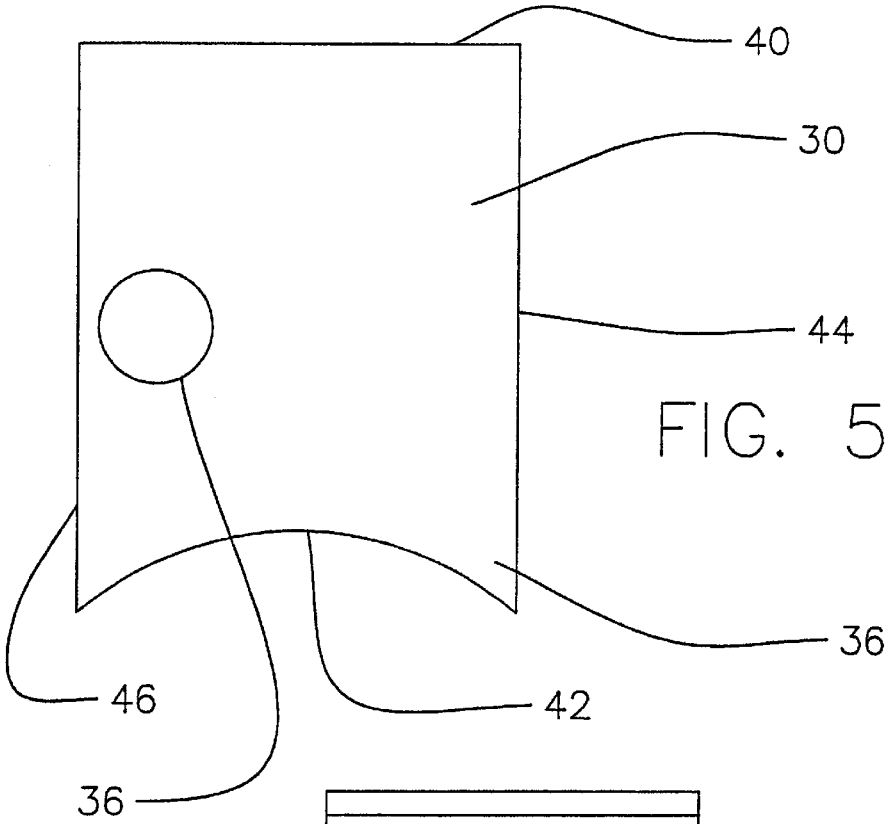
FIG. 5 is a schematic side view of the block device.
Figure 4:
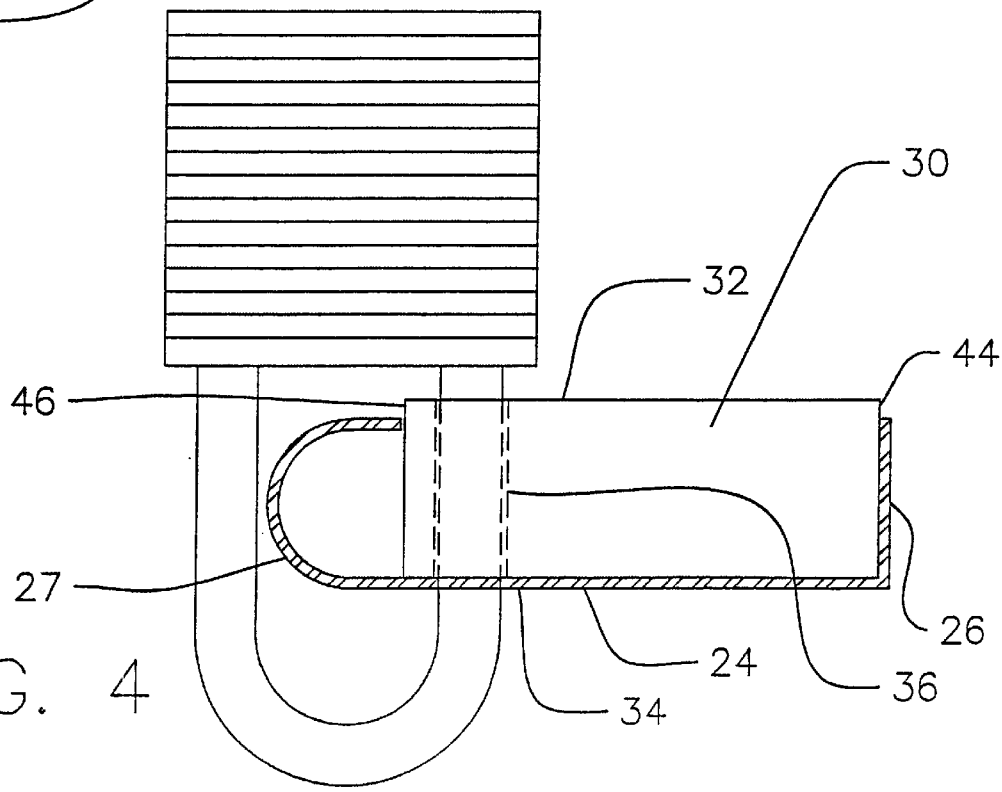
FIG. 4 is a schematic sectional view of the present invention taken along line 4—4 of FIG. 3.

With reference now to the drawings, and in particular to FIGS. 1 through 5 thereof, a new overhead door movement blocking system embodying the principles and concepts of the present invention and generally designated by the reference numeral 10 will be described.

As best illustrated in FIGS. 1 through 5, the overhead door movement blocking system 10 generally comprises a block device 30, and may also include a padlock 50.

The system 10 of the invention is most suitably employed on overhead doors 12 that are typically installed on structures, such as vehicle garages, with relatively large openings. Guide tracks 14 for the overhead door are typically positioned on each side of the opening, and extend substantially vertically upwardly from the floor of the structure on an interior of the structure adjacent to the portions of the door jamb at the sides of the opening. The guide tracks each have a channel 16 therein for receiving and guiding movement of a guide roller 18 of a overhead door mount 20. Each overhead door mounts 20 mounted on an interior surface 22 of the overhead door, so that multiple rollers are positioned in the channel. The guide track generally has a base wall 24 and a pair of side walls 26, 27 that extend from the base wall to form a track with a generally C-shaped transverse cross-section. An inner side wall 27 of the guide track often has an inwardly concave shape, while an outer side wall 26 often has a relatively flat shape. The base wall 24 of the guide track may have one or more holes that extend through the base wall for permitting the attachment of various mounting structures to the track that are in turn mounted on a wall of the structure adjacent to the opening. Optionally, one or more holes 28 may be formed in the base wall of the guide track by drilling through the base wall at a suitable location on the track for permitting the installation of the block device.

The overhead door movement blocking system of the invention includes a block device 30 for positioning in the channel of the guide track to obstruct movement of the guide roller in the channel past the block device. The block device 30 has inner 32 and outer 34 faces, which may be substantially planar. An aperture 36 is formed in the block device for aligning with the hole 28 in the base wall of the guide track when the block device is positioned in the channel against a guide roller while the overhead door is in a closed condition. The aperture 36 extends between the inner 32 and outer 34 faces. The block device has opposite first 38 and second 40 ends. The first end 38 is adapted for positioning adjacent to the guide roller of the overhead door. The first end 38 preferably has a concave face 42 for positioning adjacent to the guide roller. The block device 30 also has a pair of opposite sides 44, 46 that extend between the first 38 and second 40 ends, and the sides are each positionable adjacent to one of the side walls 26, 27 of the guide track.

Optionally, the invention may include a padlock 50 which has a shackle portion 52 and a case portion 54. The shackle portion is positionable through the hole 28 of the guide track and the aperture 36 of the block device for securing the block device in the channel to block movement of the guide roller in the channel past the block device.

In an illustrative embodiment of the invention, the block device may be formed from metal bar stock. The block device may have a width of approximately 1.5 inches for fitting between the side walls of the guide track without rotating in the channel, and may have a thickness of approximately 0.75 inches for occupying and filling a major portion of the channel of a typical guide track. The block may have a length between ends of approximately 3 inches. The aperture in the block device may have a diameter of approximately five-sixteenths of an inch, and the hole in the guide track may be about the same, which has been found suitable for receiving the shackle portion of a padlock. One suitable padlock has a shackle with a clearance of approximately one and three-quarters inches to two inches.

In use, a user of the invention moves the overhead door to a closed position and positions the block device in the channel of the guide track for the overhead door in a location above the guide roller of the overhead door. If a hole is present in the guide track, the user aligns the aperture in the block device with the hole in the guide track and passes a shackle of a padlock through the aperture in the block device and the hole in the guide track and secures the shackle in a locked position. A block device may be installed on each guide track above a guide roller mounted on each side of the overhead door. Preferably, the block device is positioned above the third guide roller from the floor of the structure, although positioning adjacent to other guide rollers on the overhead door.

If no appropriately located hole is present in the guide track, the user may simply position the overhead door in the closed position, place the block device in the channel of the guide track above the guide roller with the concave face of the first end being positioned adjacent to and abutting against the guide roller, and bore a hole through a base wall of the guide track that is in axial alignment with the aperture in the block device. Preferably, a drill bit is inserted through the aperture in the block device while the block device is abutted against the guide roller and the block device is used as a guide for the drill bit as the drill bit bores through the base wall of the guide track.

It should be realized that the invention is most suitably employed on structures having access to the interior separate from the opening covered by the overhead door so that the user is blocked from leaving the structure once the invention has been installed on the overhead door, and similarly so the user can get into the structure to remove the invention from the overhead door when use of the door is desired. It will also be realized that if unauthorized access is gained through another door into the structure, movement of large items such as vehicles through the opening of the overhead door is still impeded, if not completely prevented, by the presence of the invention since the padlock still needs to be removed to raise the overhead door. For further security, the fasteners securing the overhead door mount to the overhead door may be of the tamper-proof type (such as, for example, those requiring a specialized tool to remove) or the heads of more conventional fasteners may be tack welded to the metal overhead door mount.

Further, it is preferable that overhead doors with automatic openers have some means of preventing the use of the automatic opener when the invention is installed. Also, the block device may be employed to block movement of the overhead door from an open condition to a closed condition, although the invention is most suitable for blocking movement of the overhead door from the closed condition to the open condition.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An overhead door movement blocking system, comprising:

a guide track of an overhead door, the guide track having a channel for receiving and guiding movement of a guide roller of an overhead door mount, the guide track having a hole formed therein;

a block device for positioning in the channel of the guide track to obstruct movement of the guide roller in the channel past the block device, the block device having inner and outer faces, an aperture being formed in the block device for aligning with the hole in the guide track when the block device is positioned in the channel, the aperture extending between the inner and outer faces, the block device having opposite first and second ends, the first end being positionable adjacent to the guide roller of the overhead door, the first end having a concave face for positioning adjacent to and abutting the guide roller, the block device having a pair of opposite sides extending between the first and second ends for each being positioned adjacent to one of the side walls of the guide track; and a padlock having a shackle portion and a case portion, the shackle portion being positionable through the hole of the guide track and the aperture of the block device for securing the block device in the channel to block movement of the guide roller in the channel past the block device.

2. A method of securing an overhead door in a closed position in a door opening of a structure, the overhead door being mounted on a guide track defining a channel for receiving a guide roller of a overhead door mount, the method comprising:

providing a block device having inner and outer faces, an aperture being formed therein, the aperture extending between the inner and outer faces, the block device having opposite first and second ends, the first end being positionable adjacent to the guide roller of the overhead door, the first end having a concave face for positioning adjacent to the guide roller;

moving the overhead door to a closed position;

positioning the block device in the channel of the guide track for the overhead door in a location above the guide roller of the overhead door;

aligning the aperture in the block device with a hole in the guide track;

passing a shackle of a padlock through the aperture in the block device and the hole in the guide track and securing the shackle in a locked position.

3. The method of claim 2 additionally comprising the act of placing the block device in the channel of the guide track above the guide roller with the concave face of the first end being positioned adjacent to and abutting against the guide roller and boring the hole through a base wall of the guide track in axial alignment with the aperture in the block device.

4. The method of claim 3 wherein the act of boring includes inserting a drill bit through the aperture in the block device such that the block device acts as a guide for the drill bit.

5. An overhead door movement blocking system comprising:

a guide track of an overhead door, the guide track having a channel for receiving and guiding movement of a guide roller of an overhead door mount, the guide track having a hole formed therein;

a block device for positioning in the channel of the guide track to obstruct movement of the guide roller in the channel past the block device, the block device having inner and outer faces, an aperture being formed in the block device for aligning with the hole in the guide track when the block device is positioned in the channel, the aperture extending between the inner and outer faces, the block device having opposite first and second ends, the first end being positionable adjacent to the guide roller of the overhead door, the block device having a pair of opposite sides extending between the first and second ends for each being positioned adjacent to one of thee side walls of the guide track; and securing means for removably securing the block device in the channel of the guide track;

wherein the securing means comprises a padlock having a shackle portion and a case portion, the shackle portion being positionable through the hole of the guide track and the aperture of the block device for securing the block device in the channel to block movement of the guide roller in the channel past the block device.

6. The system of claim 5 wherein the securing means is removably positionable through the hole of the guide track and the aperture of the block device for securing the block device.

7. The system of claim 5 wherein the securing means removably embraces a portion of the block device and a portion of the guide track.

8. The system of claim 5 wherein the first end of the block device has a concave face for positioning adjacent to and abutting the guide roller.

9. The system of claim 5 wherein substantially an entirety of the block device is positionable in the channel of the guide track.

* * * * *